US011634258B2

(12) United States Patent
Nisler et al.

(10) Patent No.: US 11,634,258 B2
(45) Date of Patent: Apr. 25, 2023

(54) COVER FOR DRUG PRODUCT BOTTLES

(71) Applicant: BioFlex Solutions LLC, Hackettstown, NJ (US)

(72) Inventors: Jason C. Nisler, Newton, NJ (US); Ralph M. Meola, Hackettstown, NJ (US)

(73) Assignee: BioFlex Solutions LLC, Hackettstown, NJ (US)

( * ) Notice: Subject to any disclaimer, the term of this patent is extended or adjusted under 35 U.S.C. 154(b) by 0 days.

(21) Appl. No.: 17/481,881

(22) Filed: Sep. 22, 2021

(65) Prior Publication Data

US 2022/0009682 A1 Jan. 13, 2022

Related U.S. Application Data

(63) Continuation-in-part of application No. 16/537,853, filed on Aug. 12, 2019, now Pat. No. 11,491,082.

(51) Int. Cl.
*B65D 55/02* (2006.01)
*A61J 1/14* (2023.01)

(52) U.S. Cl.
CPC ..... *B65D 55/02* (2013.01); *A61J 1/1418* (2015.05); *B65D 2401/00* (2020.05)

(58) Field of Classification Search
CPC ..... B65D 23/108; B65D 51/18; B65D 41/34; B65D 41/62; B65D 55/02
USPC ..... 215/274
See application file for complete search history.

(56) References Cited

U.S. PATENT DOCUMENTS 5,385,373 A * 1/1995 Love ..... F16B 41/007 403/313

FOREIGN PATENT DOCUMENTS

WO WO-9303702 A1 * 3/1993 ..... A61J 1/10
WO 2020123879 A1 6/2020

OTHER PUBLICATIONS

European Search Report and Written Opinion for Application No. EP22196852, dated Jan. 25, 2023, 6 pages.

* cited by examiner

*Primary Examiner* — Mollie Impink
(74) *Attorney, Agent, or Firm* — KDW Firm PLLC

(57) ABSTRACT

The cover for a drug product bottle with transfer tubes extending therefrom. The cover is made with two parts that close on each other over a screw cap on a drug product bottle. The parts each have a ledge that fits under the screw cap, an intermediately disposed flange that rests on the screw cap and a semi-circular lid spaced from the flange. The flanges and lids define an encapsulated space when the parts are in a closed position to encapsulate the transfer tubes extending from the bottle.

5 Claims, 5 Drawing Sheets

COVER FOR DRUG PRODUCT BOTTLES

This is a Continuation-in-Part of application Ser. No. 16/537,853, filed Aug. 12, 2019 and, claims the benefit of Provisional Patent Application 62/720,273, filed Aug. 21, 2018.

This invention relates to a cover for drug product storage bottles.

As is known, the pharmaceutical and biotech industries commonly store, freeze, ship and transport expensive drug product in various plastic bottles and containers. Due to the high value of the drug product, it is essential to maintain the bottled product safely and with integrity. To this end, the bottles must remain sealed from the atmosphere once filled with the product, usually a liquid, and undamaged until use, for example in a final step of a drug manufacturing process.

In some case, the bottles have screw caps with ancillary fittings or tube connections penetrating through the cap. In some of these cases, the screw caps have an opening in the top surface that allows an elastomer flat washer to be placed between the screw cap and bottle top or allows an elastomer stopper with integrated tubing to be inserted into the bottle top. The washer will create the liquid seal to ensure fluid does not come out of the bottle cap. The added elastomer stopper allows tubing to be added to pump liquid in and out of the bottle in a clean and sterile manner, thus, creating a closed system or process.

In the case of an added elastomer stopper with tubing, once the tubing is finished being used, the tubing must be sealed in some fashion.

Accordingly, it is an object of the invention to provide a cover for a drug product bottle having a screw cap with ancillary fittings or tube connections penetrating through the cap.

It is another object of the invention to provide a cover for a drug product bottle with a washer or an elastomeric stopper under an apertured screw cap as a primary barrier to the environment for the bottle contents.

Briefly, the invention provides a cover that will fit and, encapsulate a bottle top screw cap of a drug product bottle and any ancillary fittings or tube connections penetrating through the cap.

The cover serves two primary purposes. One will be to protect the bottle cap, tubing and assembly from damage during storage, handling or transit. The second purpose will be to serve as a tamper evident mechanism which will protect a valuable drug product within the bottle from the bottle mistakenly being opened and to ensure that the drug product remains unadulterated.

In the case of a drug product bottle with ancillary fittings or tube connections penetrating through the screw cap, the cover maintains the fittings or tube connections in a closed condition and protects these against damage, thus maintaining an airtight barrier.

The cover is of two part construction with parts that hinge or clamp around the cap. Alternatively, the cover can be manufactured as a single unit with a flexible hinge point. The two parts or sides of the cover are constructed to snap shut on each other via an undercut barb that secures the two halves closed around the bottle cap. Once installed in place, the cover cannot be removed without cutting or damaging the parts.

The pair of parts are hingedly secured together to move between an open position and a closed position. When in the closed position the two parts are in facing relation to each other to form a cup shape.

Each part has a semi-cylindrical periphery, a semi-circular lid and a radially inwardly directed ledge along a bottom edge of the semi-cylindrical periphery to fit under the cap of the bottle in the closed position. In addition, a lip projects from the periphery and the lid of one part for slidable reception within the other part in the closed position to seal the parts together in face-to-face manner.

In addition, each part of the cover has a radially inwardly directed semi-circular flange disposed intermediately between the lid and ledge and located to rest on the screw cap when the cover is in the closed position. When the cover is in the closed position, the space between the flanges and the lids of the cover parts is closed to the environment and encapsulates any ancillary fittings or tube connections penetrating through the screw cap.

This embodiment of the cover may be used with a drug product bottle having a screw cap that is apertured and a washer that is disposed between the bottle and the screw cap to provide a seal.

This embodiment of the cover may also be used with a drug product bottle having a screw cap that is apertured and an elastomeric stopper that is inserted into the bottle with at least one integrated tubing extending through the stopper and screw cap for transporting liquid into and out of the bottle; When the cover is in the closed position, the tubing extends into and is encapsulated within the space between the flanges and the lids of the cover parts.

This embodiment of the cover may also be used with a drug product bottle having a screw cap that is integrated with one or more transfer tubes which are used to transport liquid into and out of the bottle without removing the screw cap.

These and other objects of the invention will become more apparent form the following detailed description taken in conjunction with the accompanying drawings wherein.

Figure 1:
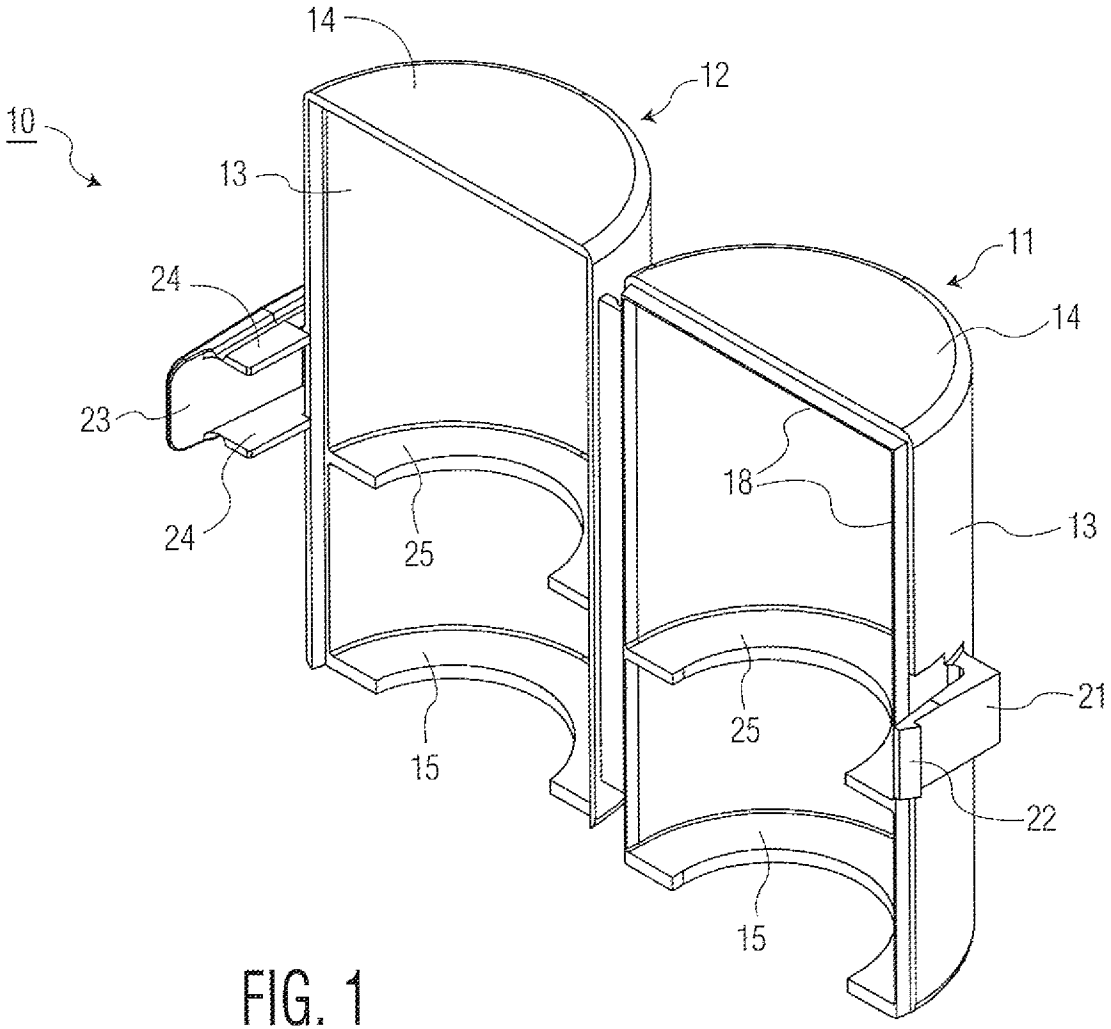
FIG. 1 illustrates a perspective view of a cover in accordance with the invention in an open position.

Referring to FIG. 1, the cover 10 is formed of two parts 11, 12 that are hinged together either via an integral hinge or a hinge pin connection (not shown) to move between an open position, as illustrated, and a closed position.

Figure 2:
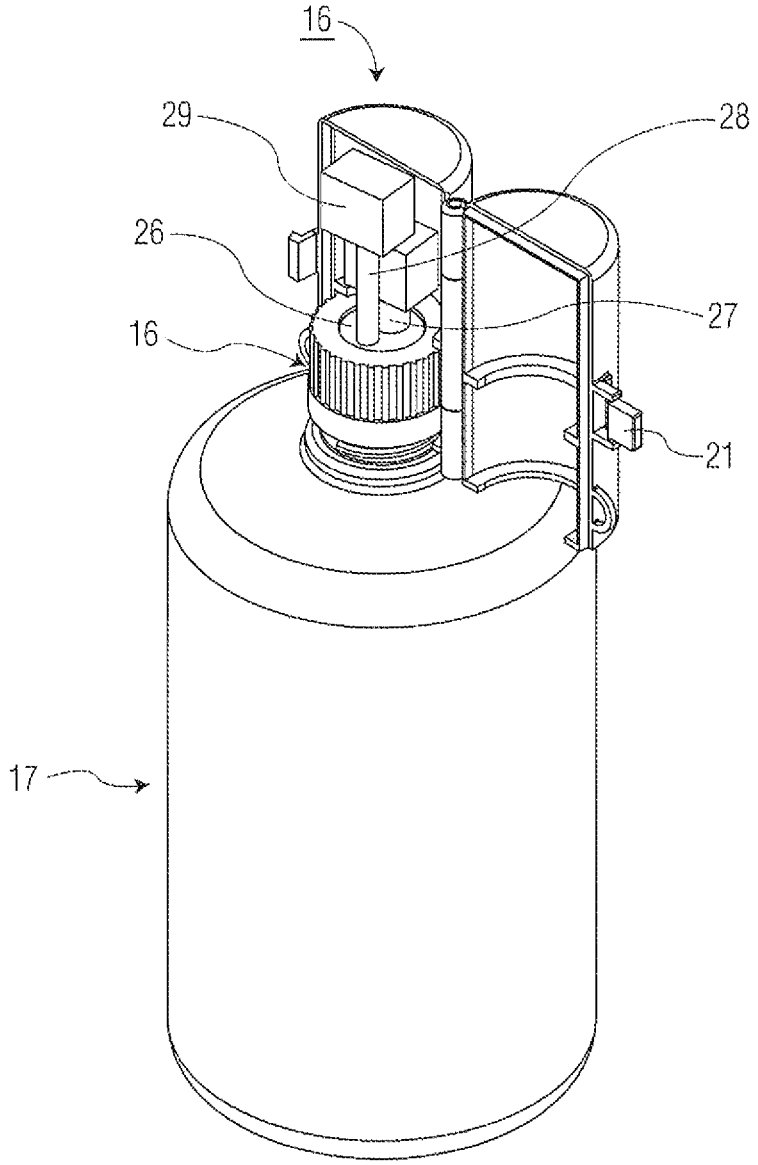
FIG. 2 illustrates a perspective view of a drug product bottle having an elastomeric stopper with integrated tubing and the cover of FIG. 1 being secured in place in an open position.

Referring to FIGS. 1 and 2, the two parts 11, 12 of the cover 10 forma cup shape when closed together on each other. As illustrated, each part 11, 12 has a semi-cylindrical periphery 13 and a semi-circular lid 14. In addition, each part 11, 12 has a radially inwardly directed ledge 15 along the bottom edge, as viewed, of the semi-cylindrical periphery 13 to fit under a screw cap 16 on a bottle 17 as shown in FIG. 2 when the two parts 11, 12 are closed on each other.

One part 11 also has a lip 18 that projects from the periphery 13 and the lid 14 towards the other part 12 and is sized to be slidably received within the other part 12 when the two parts 11, 12 are closed on each other. The lip 18 serves to seal the two parts 11, 12 together in face-to-face manner when the two parts 11, 12 are closed on each other by being slidably disposed within the other part 12.

Figure 4:
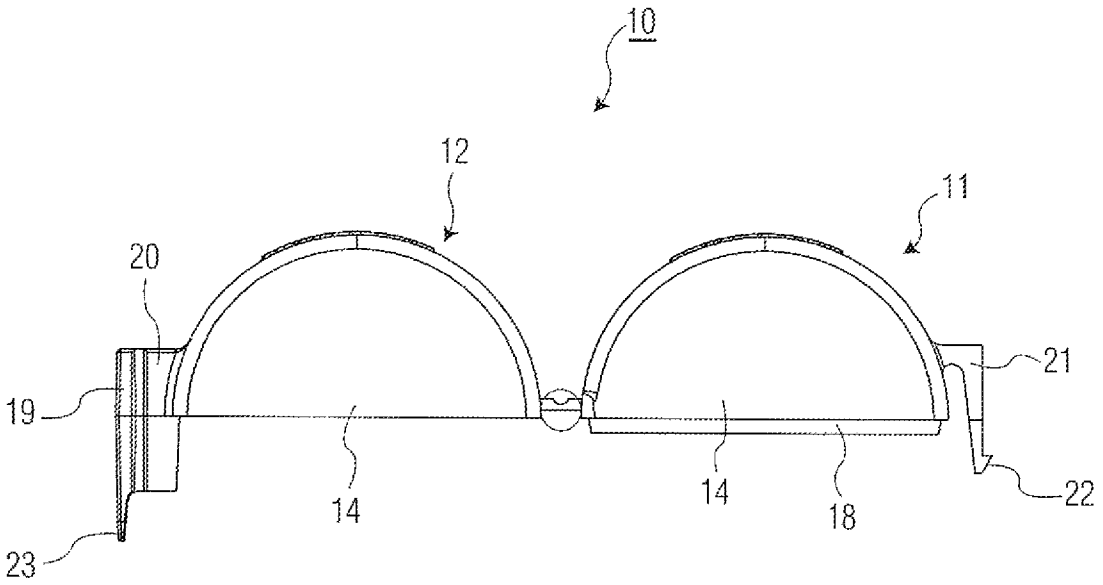
FIG. 4 illustrates a top view of the cover of FIG. 1 in an open position.

Referring to FIGS. 1 and 4, the parts 11, 12 are provided with a lock to secure the two parts 11, 12 together in a permanent manner when in the closed position. As shown, the lock includes an integral abutment 19 on the outside of the periphery 13 of one part 12 located at a mid-point of the periphery 13 and formed with a slot 20 of rectangular shape.

The lock also has an integral tab 21 that projects from a mid-point of the other part 11 towards the abutment 19. This tab 21 has a barb 22 at the end that is sized to slide through the slot 20 of the abutment 19 and to engage behind the abutment 19 when the two parts 11, 12 are closed on each. The locking of the tab 21 to the abutment 19 serves as a secure lock for the cover 10 when closed and is intended to be permanent to the extent that the tab 21 cannot be withdrawn for the abutment 19 without destroying the tab 21 and/or abutment 19.

Figure 5:
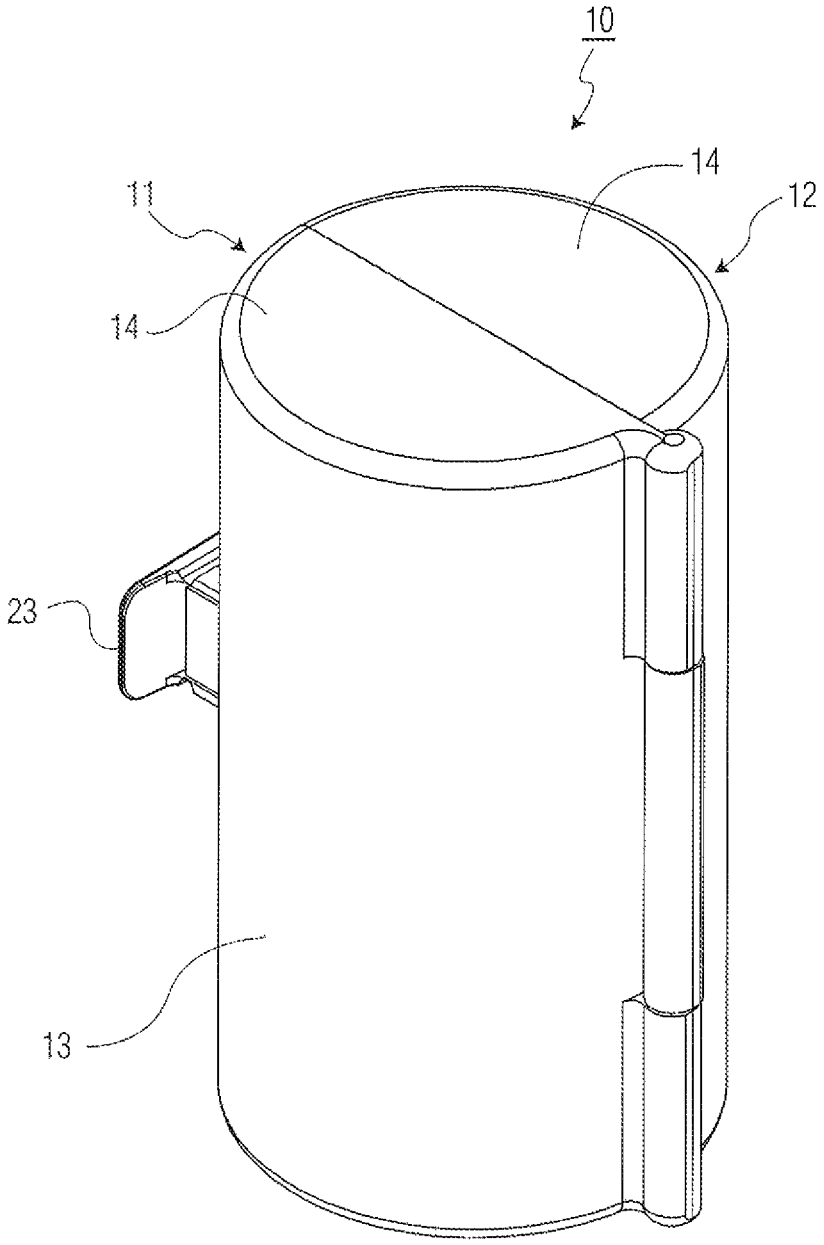
FIG. 5 illustrates a view of the drug product bottle of FIG. 2 with the cover in a closed position.

The abutment 19 also has an extension 23 with two ears 24. The extension 23 is integrally hinged in place to pivot over the tab 21 when the parts 11, 12 are in the closed position and the tab 21 inserted in the abutment 19. The ears 24 are sized and spaced apart from part 12 to create a gap to the receive tab 21 with the barb 22 into the abutment 19 and to snap the cover 10 in the closed position as indicated in FIG. 5.

Figure 3:
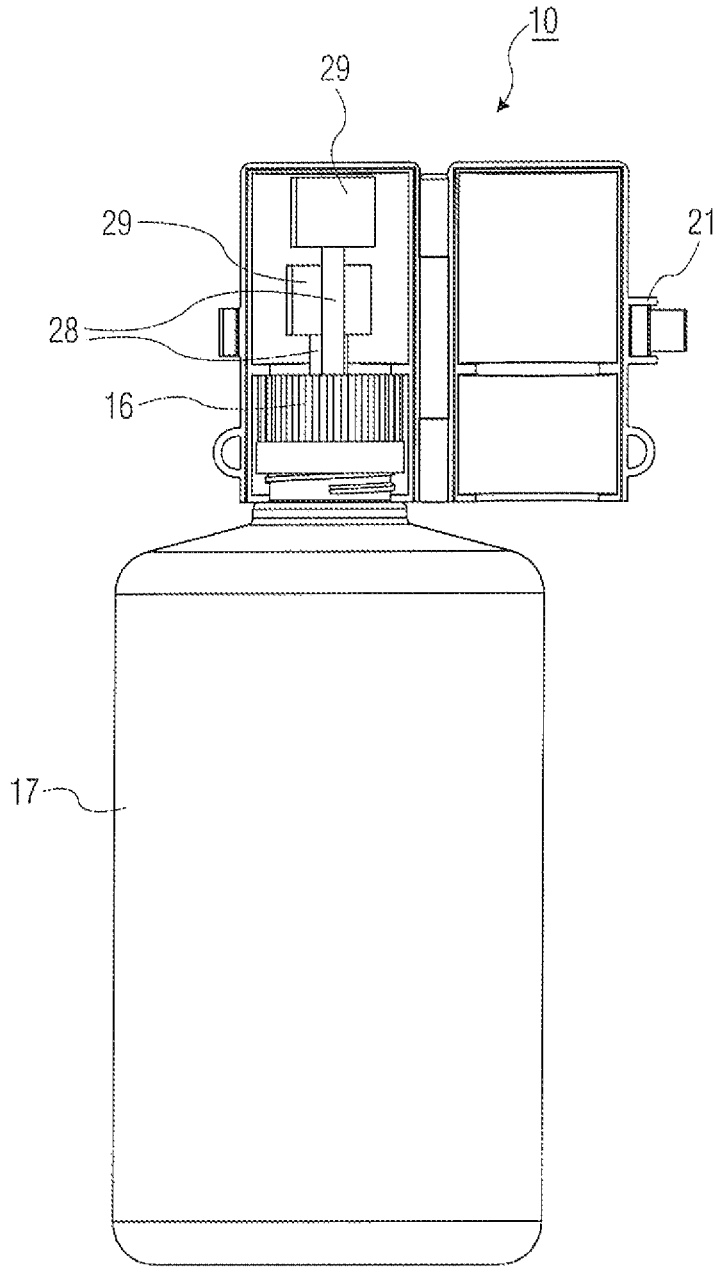
FIG. 3 illustrates a view of the drug product bottle of FIG. 2 with the cover in an open position.

Referring to FIGS. 1, 2 and 3, each part 11, 12 has a radially inwardly directed semi-circular flange 25 disposed intermediately between the lid 14 and ledge 15 and located to rest on the screw cap 16 when the cover 10 is in the closed position.

Referring to FIG. 2, the screw cap 16 has a central opening 26 and the bottle 17 has an elastomeric stopper 27 fitted into the top of the bottle 17. As illustrated, the stopper 27 has a pair of tubes 28 extending therefrom. The tubes 28 may be molded in place with the stopper 27 as is known or may be integrated with the screw cap 16 as is also known. In either case, the tubes 28 serve as transfer tubes that transport liquid into and out of the bottle 17 without removing the screw cap 16.

As illustrated, the tubes 28 extend upwardly from the stopper 27 and are capped off with an aseptic cover 29 that ensures no air gets back into the tubes 28 and into the bottle 17. Alternatively, the tubes 28 may have a crimp seal, a fold over of the tubing, or a sterile vent end. All are to ensure that no contaminants go back through the open tubes 28 and into the bottle 17.

Where the tubes 28 are integrated with the screw cap 16, spigots (pot shown) may be integrated in the screw cap 16 with the tubes 28 extending from the spigots, In this case, the spigots add rigidity or support to the soft tubes 27 only.

Referring to FIGS. 2 and 3, the space between the inwardly directed semi-circular flanges 24 and the lids 14 of each part 11, 12 is dimensioned to receive the tubes 28 and aseptic covers 29 in an encapsulated manner thereby sealing off the tubes 27 from the surrounding environment.

In another embodiment, the cover may be fitted with a handle assembly (not shown) to facilitate handling of a filled bottle in a manner as described in the parent application Ser. No. 16/537,853 the disclosure of which is incorporated herein.

The invention thus provides a cover to protect exposed transfer tubing extending from a drug product bottle.

The invention also provides a cover that will fit and encapsulate a bottle top screw cap of a drug product bottle and any ancillary fittings or tube connections penetrating through the cap in a simple economical manner.

What is claimed is:

1. A cover for mounting over a screw cap on a drug product bottle, said cover comprising a pair of parts hingedly secured together to move between an open position and a closed position in facing relation to each other to form a cup shape in said closed position; and each said part having a semi-cylindrical periphery, a semi-circular lid, a radially inwardly directed ledge along a bottom edge of said semi-cylindrical periphery to fit under the screw cap of the bottle in said closed position, and a radially inwardly directed semi-circular flange intermediately between said lid and said ledge to rest on the screw cap and to define an encapsulated space between the semi-circular lids and the screw cap wherein the cover further comprises a lock for securing said parts together, said lock including an integral abutment with a slot of rectangular shape on one of said pair of parts and an integral tab with a barb on the other part of said pair of parts sized to slide through said slot and to engage behind said abutment in said closed position, and wherein said lock further includes an extension on said abutment for pivoting over said tab in said dosed position, said extension having a pair of ears to snap-fit onto the back of said tab to shield and hold said tab in said abutment.

2. A cover as set forth in claim 1 further comprising a lip projecting from said periphery and said lid of one of said pair of parts for slidable reception within the other part of said pair of parts in said closed position to seal said pair of parts together in face-to-face manner.

3. In combination, a drug product bottle;

a screw cap threadably secured to said bottle;

at least one tube extending from said cap for transporting liquid into and out of the bottle; and a cover mounted over said screw cap, said cover having a pair of parts hingedly secured together to move between an open position and a closed position in facing relation to each other to form a cup shape in said closed position; each said part having a semi-cylindrical periphery, a semi-circular lid, a radially inwardly directed ledge along a bottom edge of said semi-cylindrical periphery to fit under said screw cap in said closed position and a radially inwardly directed semi-circular flange intermediately between said lid and said ledge to rest on said screw cap and to define a space encapsulating said tube therein.

4. The combination as set forth in claim 3 further comprising an aseptic cover on said tube within said space.

5. The combination as set forth in claim 3 wherein said screw cap has a central opening and further comprising an elastomeric stopper in said bottle with said tube extending therefrom through said screw cap.

* * * * *